US007337821B2

(12) United States Patent
Sciortino

(10) Patent No.: US 7,337,821 B2
(45) Date of Patent: Mar. 4, 2008

(54) APPARATUS FOR MAKING CORRUGATED WALLS

(76) Inventor: Philip J. Sciortino, Via Balbo 39, Turin (IT) 10124

( * ) Notice: Subject to any disclaimer, the term of this patent is extended or adjusted under 35 U.S.C. 154(b) by 514 days.

(21) Appl. No.: 11/140,173

(22) Filed: May 31, 2005

(65) Prior Publication Data

US 2005/0217800 A1 Oct. 6, 2005

Related U.S. Application Data

(62) Division of application No. 10/705,573, filed on Nov. 12, 2003, now Pat. No. 7,010,896.

(51) Int. Cl.
*B28B 11/10* (2006.01)

(52) U.S. Cl. ..... 156/459; 156/547

(58) Field of Classification Search ..... 156/470, 156/471, 459, 474, 547; 425/371, 336, 369, 425/370, 505

See application file for complete search history.

(56) References Cited

U.S. PATENT DOCUMENTS 2,764,193 A * 9/1956 Knowles ..... 144/254

* cited by examiner

*Primary Examiner*—Richard Crispino
*Assistant Examiner*—Barbara J. Musser

(57) ABSTRACT

There is a description of an apparatus that produces corrugated walls in a continuous manner. Prior to being fed into the apparatus there is a composite consisting of an outer layer of a woven or non-woven material having a layer of a cementitious material thereon. Two composites are combined in the apparatus with a layer of polyurethane there between. The apparatus has opposing molding tracts therein through which the composites are fed. The opposing molding tracts have a multiple of inflatable pockets thereon. The spaces between the pockets form the corrugations into which the composites are being pressed. At the end of the run of the molding tracts, the molded corrugated wall is then delivered to a roller run to be dried to its last extent.

8 Claims, 7 Drawing Sheets

APPARATUS FOR MAKING CORRUGATED WALLS

CROSS-REFERENCE TO RELATED APPLICATIONS

This application is a Divisional of application Ser. No. 10/705,573 Nov. 12, 2003 now U.S. Pat. No. 7,010,896.

BACKGROUND OF THE INVENTION

This invention is directed to a process and apparatus for making corrugated walls that are very rigid and lightweight and may take the place of concrete blocks or cinder blocks which have to be assembled piece or block by block. The present invention can be manufactured to any width and to any length and can easily be assembled on site.

SUMMARY OF THE INVENTION

The present invention can be manufactured in a continuous mode by an apparatus that can be running continuously to a certain extent. There are several composite materials that are being used, such as, concrete, polyurethane and woven and non-woven cloth. The materials are combined and fed into an apparatus in a unique way and in a quickly drying way.

DETAILED DESCRIPTION OF THE INVENTION

Figure 1:
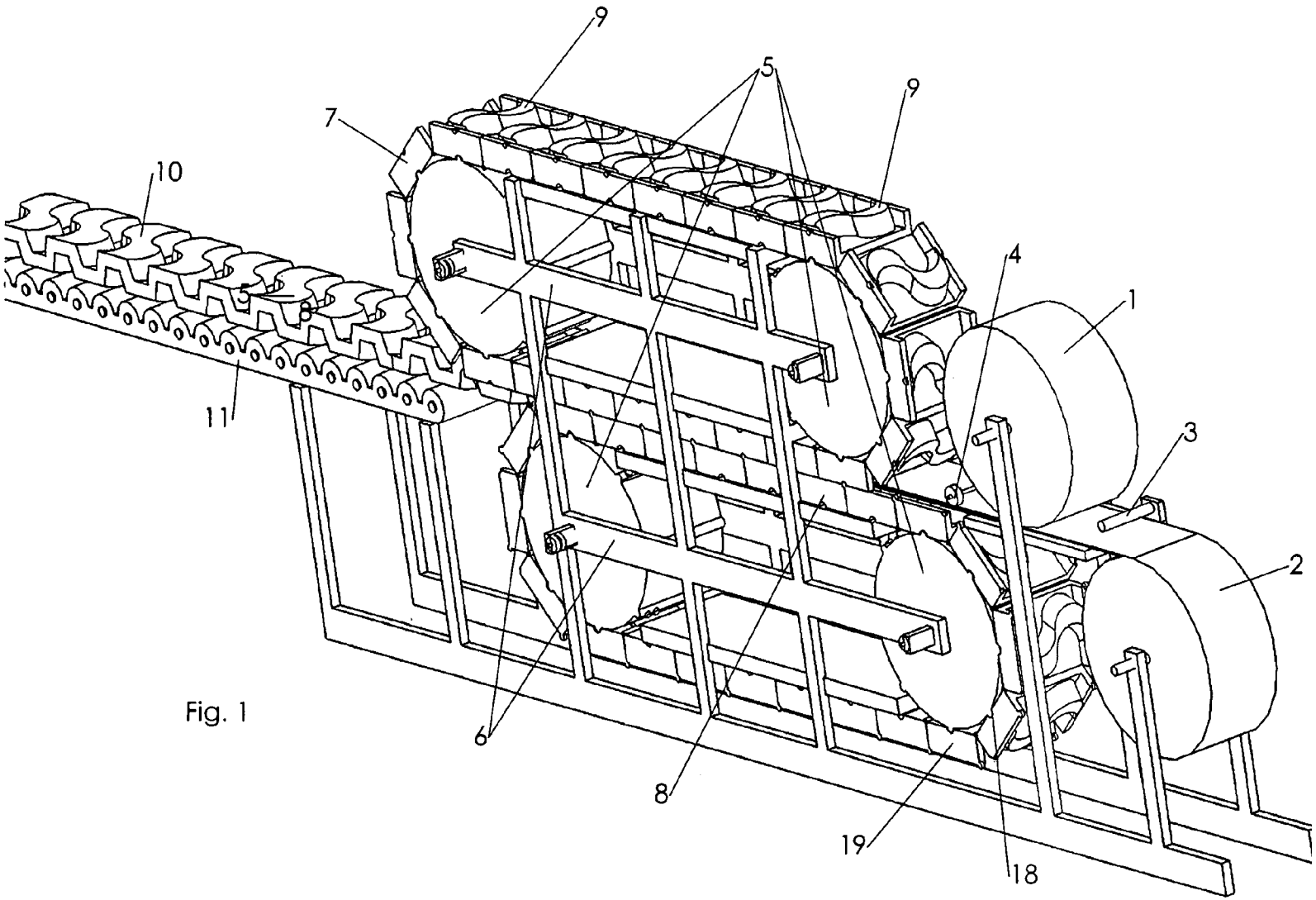
FIG. 1 is a perspective view of the overall apparatus.

FIG. 1 is a perspective view of the apparatus which will manufacture wall components in a continuous manner. At the beginning of the apparatus there are located 2 two material delivery rollers 1 and 2. Each of the rollers 1 and 2 have an outer layer of woven or non-woven fabric and between the layers of the roller there located a cementitious material of a thickness of about ½ to one inch thickness. (A side view of this arranged can be seen in FIG. 5) The state of the cementitious material is such that it cannot easily run out from between the layers of the wound roller but pliable enough so that it can easily be pressed into the pockets of the mold belts or conveyers 7 and 8. The mold conveyors or belts are driven by the drive wheels 5. There is a polyurethane spreader ejector 3 located across the whole width of the incoming composite. A layer of polyurethane is spread across the width and on top of the incoming composite to be united with the bottom of the incoming composite and sandwiched between the upper composite 1 and the lower composite 2. Once the two composites are united they will undergo an edge squeezing roller 4 on each side of the sandwich layers to prevent any materials from oozing out of the edges. As a next step the sandwich layers will under a molding process by being fed into an upper mold tract 7 and a lower mold tract 8. The mold tract consists of expandable pockets 9 that form a corrugating pattern that will be explained below. Suffice it to say that at this point the pockets are inflated to form a certain corrugated pattern on each the molding tracts 7 and 8. The lower molding tract 8 has the same expandable pockets thereon but being off set by 180° from each other to thereby form the undulating or corrugating pattern. At the end of the travel through the molding process, the pockets 9 must be deflated to be separable from the molding tracts. The finished product 10 exits from the molding tracts and are further conveyed by the roller device 11 to be dried or solidified thereafter. It should be noted that as soon as the polyurethane is spread on the top surface of the lower mold tract or rather the top of the lower composite, it starts to react with the atmosphere and starts to expand within and into the open spaces of both of the mold tracts 7 and 8 together with the cementitious material. The cementitious material is quick setting and should assume a somewhat rigid state when the corrugated material or structure leaves the molding process.

Figure 2:
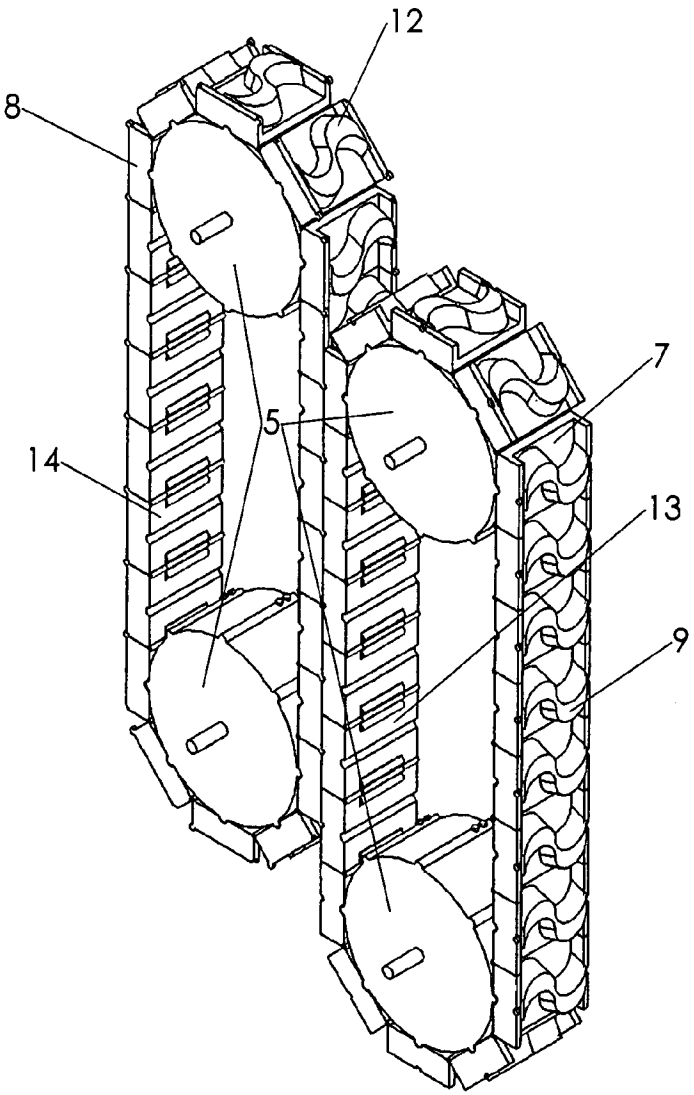
FIG. 2 is a perspective view of the interacting mold tracts.

FIG. 2 is a perspective view of the two upper 7 and lower 8 mold tracts in action. The reference characters of FIG. 1 are also transposed into this Fig. There are shown the drive wheels 5 which transport the upper 7 and the lower 8 mold tracts. Each of the mold tracts consists of a multiple of links 13 on the upper and 14 on the lower mold tracts. It can clearly be seen that there are inflatable pockets 9 on the upper mold tract 7 and pockets 12 on the lower molding tract 8. As mentioned above, the pockets 9 and 12 are off-set from each by 180° as they mesh with each other on the molding tracts. The molding tracts are each made up of a multiple of links 13 (the upper) and 14 (the lower) tract).

Figure 3:
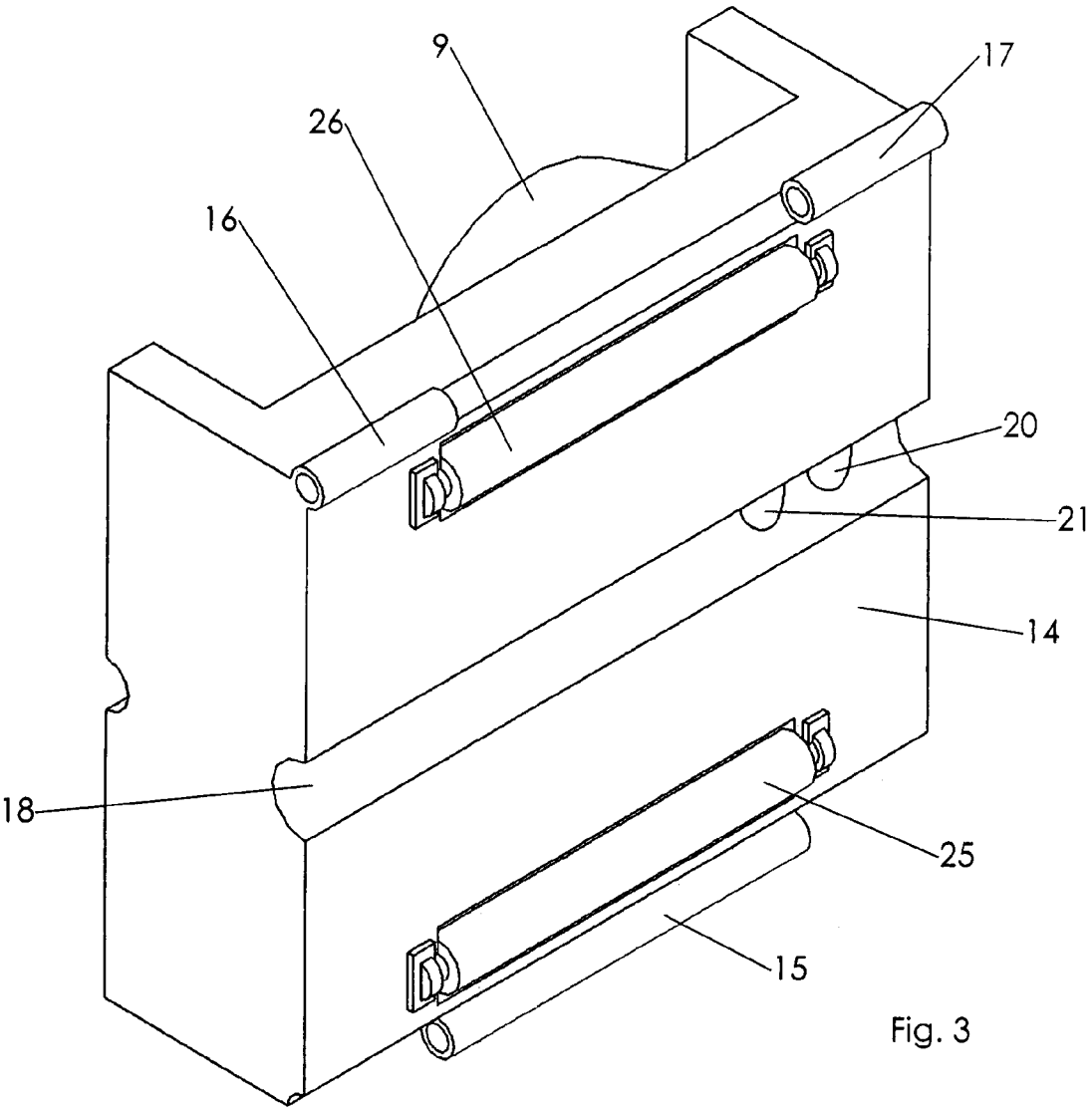
FIG. 3 is a view of the underside of an individual link of the mold tract.

FIG. 3 shows the construction of each the links of the molding tracts 7 and 8. The link consists of a rigid 14, for example on the lower tract on the underside of the link 14, for example there is shown a tubular impression 18 which will meet with the cleats 19 on the feed roller 5 (FIG. 1) so that the mold tracts can be driven in a positive and non-slipping manner. At the bottom of each of the links there are located two counterrollers 25 and 36. the purpose of these rollers is to act as a counter pressure against the frame 6 of the apparatus where the molding takes place between the upper 7 and the lower 8 molding tract. The multiple of the links are connected to each of the by linkages or hinges 15 through 17. On one side of the link 14 there is a partial tube 15 and on the other side of the link 14 there is split tube 16 and 17. A rod (not shown) pushed through the partial tube 15 and both parts 16 and 17 will connect the various links in a solid manner. At 9 there is shown a part of the expandable pocket. Also on the underside of the link in the tubular depression there is located a pressure connect opening and a vacuum opening, to be explained below.

Figure 4:
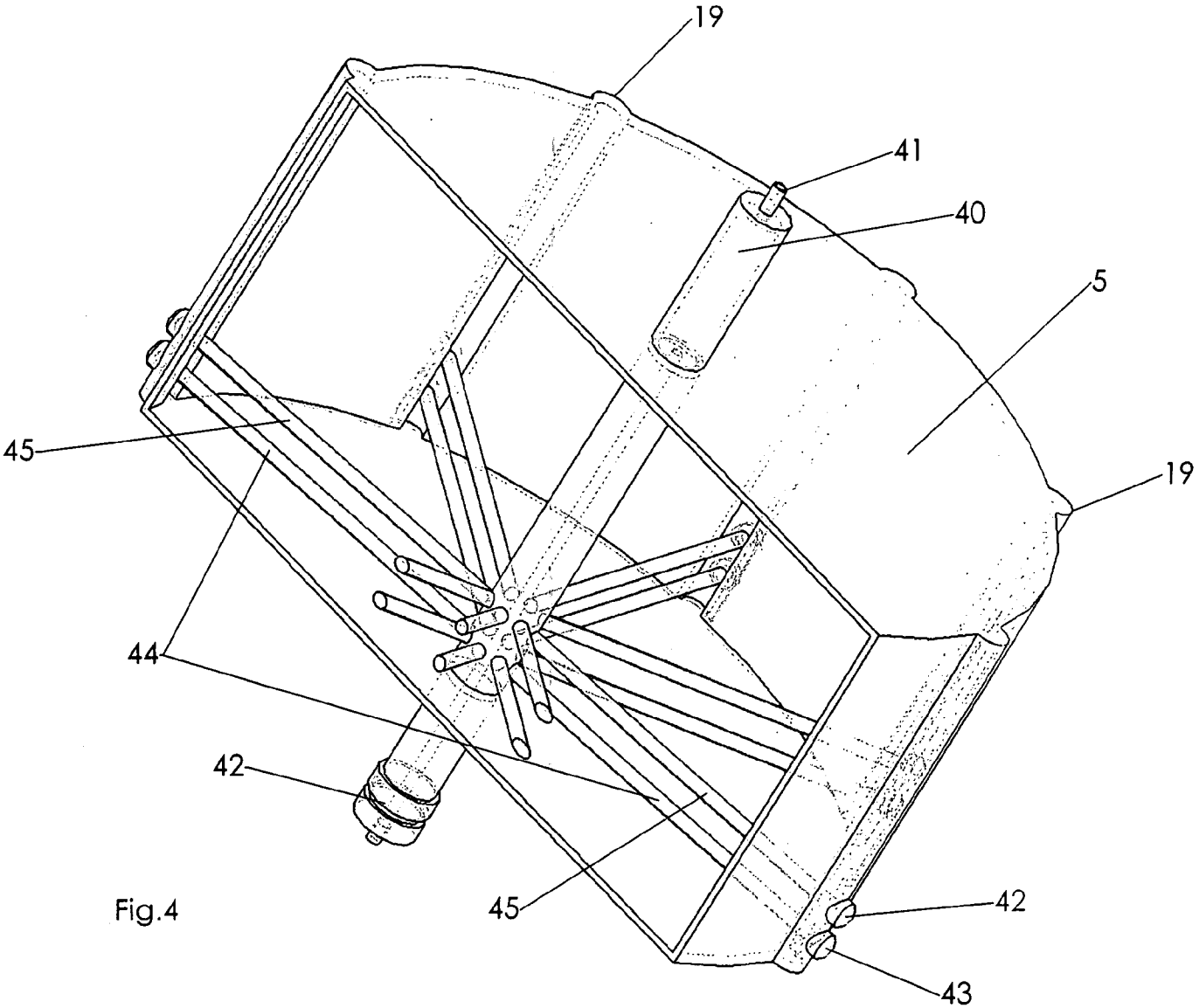
FIG. 4 is a partial view of the inside of one of the drive rollers.

FIG. 4 illustrates the arrangement of a drive roller 5 (FIG. 1) and how a connection is made between the expandable pockets 9 and 10. To this end the cleats 19 (FIG. 1) have two openings 41 and 43 therein for the purpose of pressurizing or depressurizing the expandable pockets 19. To accomplish the above, the drive shaft 40 has a central bore 41 therein that communicates with the tubes 44 and 45 for the purpose of either delivering a pressure or a vacuum to the expandable bags by way of openings or ports 42 and 43. The opening 42 has a connection with the opening 21 (FIG. 3) and the opening 43 has a connection with opening 20 (FIG. 3). There is a control mechanism (not shown) that will control the inflation or deflation of the expandable pockets at the appropriate time.

Figure 5:
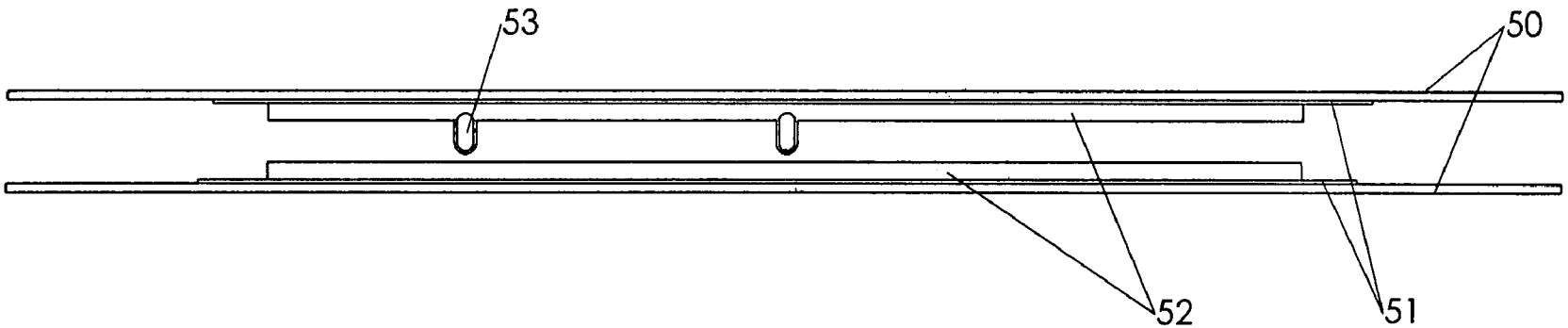
FIG. 5 is a side view of a ready made wall component.

FIG. 5 is a side view of the composite in its finished state. Both top and bottom layers are indicated as the cloth layer which could be a woven or non-woven material. 51 indicates the adhesive or polyurethane layer, while 52 indicates the cementitious layer which will give rigidity to the overall structure used as building walls or components. Within the main structure there are located flexible conduits 53. These flexible conduits 53 may carry various communication and/or utility connections when the building is constructed.

Figure 6:
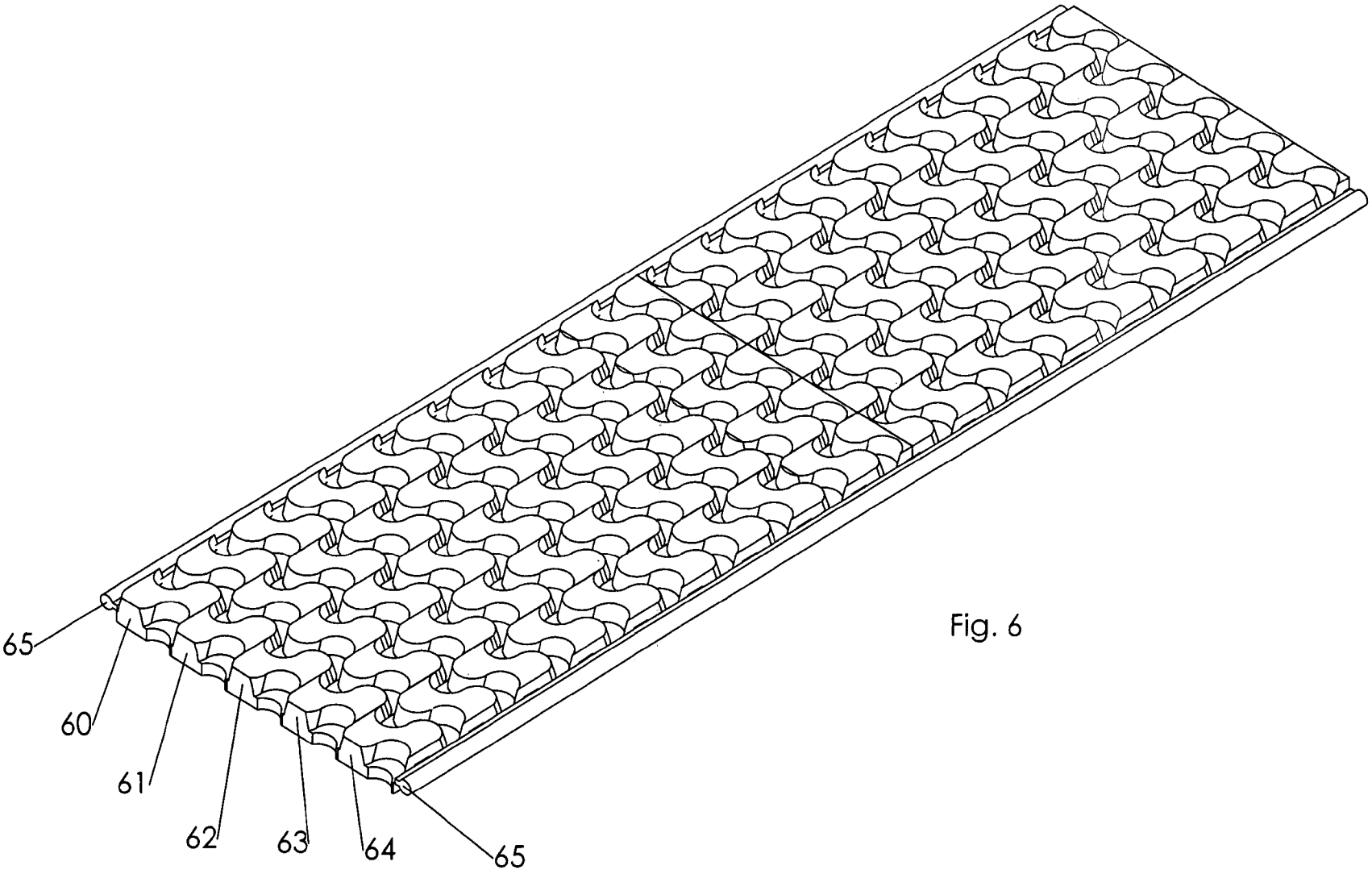
FIG. 6 is a perspective view of a ready made wall.

FIG. 6 illustrates a completed structure that is indicative of a wall of a building, for example. The prior descriptions of the invention illustrated a single treatment of a corrugated structure. The apparatus of FIG. 1 can be expanded in a multiple of ways. The composite rollers 1 and 2 can be expanded laterally to accommodate side by side composite layers and side by side upper and lower mold tracts to arrive at a substantially widened final product. This is shown FIG. 6 where side by side corrugated tracts 60-64 are shown in one wall structure. In FIG. 6 there is also shown a post construction longitudinal margin 65 which is added after the main wall has been constructed by the apparatus of this invention.

Figure 7:
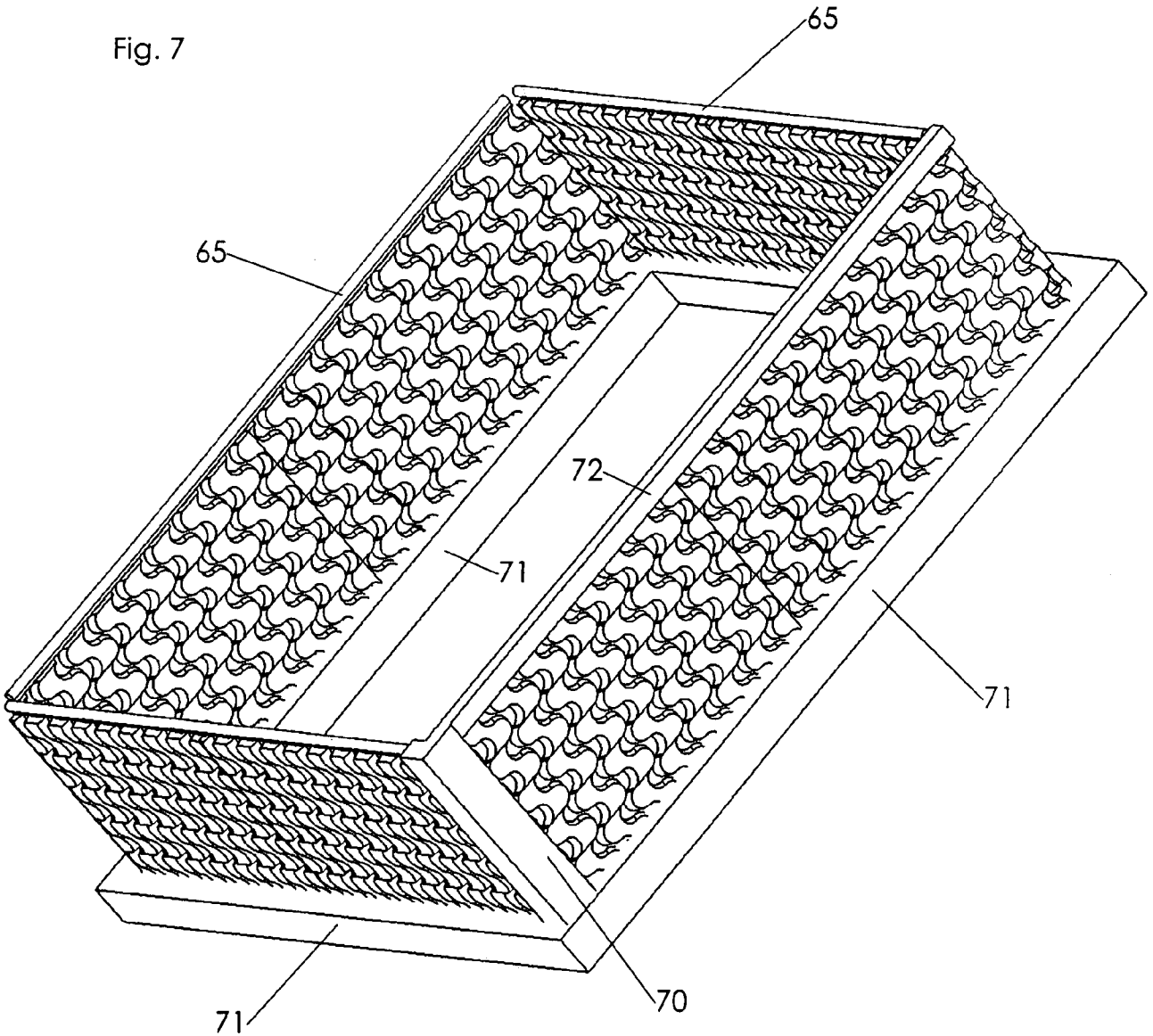
FIG. 7 is a perspective view of a housing unit.

FIG. 7 shows the use of any wall constructions after a single wall panel has been constructed by the apparatus explained above. At a single panel, there are added post fill top liners 65 of a cementitious material which will be embedded in a poured cement header 72. The corners 70 of the corrugated panels are encased in a poured corner 70 and the bottoms of the corrugated panels are encased in a bottom footer 71. This partial housing unit shows the simplicity of assembling or constructing a housing unit with most of all the elements having been pre assembled and trucked in to the building site.

The invention claimed is:

1. An apparatus for constructing corrugated walls comprising a first composite feed roller and a second composite feed roller, each of said feed rollers having layers of a fabric and cementitious material thereon, said feed rollers consisting of an upper and a lower feed rollers, means for applying a polyurethane coating on an upper surface of the composite of said lower feed roller, means for pinching edges of both of said composites after having been combined, two opposed mold tracts having inflatable molding pockets on both sides of said molding tracts forming a basis for corrugating said composite layers thereon corrugating said combined composites forming said composites into a corrugated structure, a roller transport system transporting said corrugated structure away after having been corrugated.

2. The apparatus of claim 1, wherein said corrugation is done in a continuous manner.

3. The apparatus of claim 1 including means for deflating said pockets at a point when said corrugation has been accomplished.

4. The apparatus of claim 3, wherein said feed rollers have means therein for delivering said inflating and said deflating to said pockets on said molding tracts.

5. The apparatus of claim 1, wherein said molding tracts consist of a multiple of links having said inflatable pockets thereon.

6. The apparatus of claim 5 including hinges to hinge the multiple of links together into a continuous tract.

7. The apparatus of claim 5 including a lateral depression in each of said links to match cleats on each of the feed rollers.

8. The apparatus of claim 7 wherein each of said depressions has tubular openings therein to match tubular openings on each of said cleats constituting means to deliver pressure and or vacuum to said inflatable pockets.

* * * * *